United States Patent [19]

Minami et al.

[11] Patent Number: 4,611,409

[45] Date of Patent: Sep. 16, 1986

[54] LIQUID REMOVING METHOD

[75] Inventors: Akira Minami; Sho Nakao; Takao Nakayama, all of Shizuoka, Japan

[73] Assignee: Fuji Photo Film Co., Ltd., Kanagawa, Japan

[21] Appl. No.: 620,583

[22] Filed: Jun. 14, 1984

[51] Int. Cl.[4] ..... F26B 5/14

[52] U.S. Cl. ..... 34/9; 34/14; 34/71; 34/95; 15/308

[58] Field of Search ..... 34/9, 14, 18, 19, 71, 34/90, 95, 95.3; 29/118, 123, 125; 15/306 B, 308

[56] References Cited

U.S. PATENT DOCUMENTS

| | | | |
|---|---|---|---|
| 431,174 | 7/1890 | Sargent et al. | 29/125 |
| 2,472,596 | 6/1949 | Kunz | 34/14 |
| 2,807,891 | 10/1957 | Roscoe | 34/71 |
| 3,779,206 | 12/1973 | Sato et al. | 118/63 |
| 4,129,919 | 12/1978 | Fitch et al. | 34/71 |

*Primary Examiner*—Albert J. Makay
*Assistant Examiner*—David W. Westphal
*Attorney, Agent, or Firm*—Sughrue, Mion, Zinn, Macpeak and Seas

[57] ABSTRACT

A method for removing liquid from the surface of a plate-shaped material, for instance, as applied to removing surface treatment liquids from metal plates of photographic film. While the plate-shaped material is being conveyed, a larger part of the liquid is removed from its surface by a first liquid removing device having a solid scraping surface positioned adjacent the surface of the plate-shaped material. This first liquid removing device may be a scraper blade or a pair of rollers. Subsequently, liquid remaining on the surface of the plate-shaped material is removed by a second liquid removing device, specifically, an air knife. The air flow rate and air pressure used with the air knife are sufficiently low that there is no significant scattering of liquid from the surface of the plate-shaped material.

2 Claims, 3 Drawing Figures

LIQUID REMOVING METHOD

BACKGROUND OF THE INVENTION

The present invention relates to a method in which, after the surface of a plate-shaped material is subjected to cleaning, developing or plating by using liquid, the liquid remaining on the surface of the plate-shaped material is quickly and positively removed.

The term "plate-shaped material" as used herein is primarily intended to mean a metal plate of iron, aluminum, copper or the like. However, it should be noted that plate-shaped material can also include a plastic sheet or the like. When the surface of the plate-shaped material is subjected to cleaning, developing or a plating treatment (hereinafter referred to as "liquid surface treatment", when applicable) using an appropriate liquid, heretofore the liquid remaining on the surface of the plate-shaped material has been removed using a squeeze roller or an air knife.

However, the squeeze roller is disadvantageous in that, since the remaining liquid is removed by bringing the squeeze roller into contact with the treated surface of the plate-shaped material, depending on the degree of contact and the roller's surface roughness, the treated surface may be damaged or the removed liquid may be returned to the surface of the plate-shaped material.

The air knife is also disadvantageous in that, as the quantity of liquid applied to the plate-shaped material is increased, it is necessary to increase the air quantity and the pressure of the air knife, and accordingly the liquid is liable to be strongly scattered. If the liquid is a solvent, such scattering may result in a health and/or fire hazard. Also, when the air knife is used, the angle of conveyance of the plate-shaped material is limited. When the plate-shaped material passes through the impact region of the air knife horizontally or slightly downwardly, it is difficult to move or remove the liquid which has been scraped off the plate-shaped material and pooled near the impact region, thus lowering the liquid removing efficiency.

Accordingly, an object of the present invention is to provide a liquid removing method in which the above-described difficulties accompanying a conventional liquid removing method have been eliminated, and the liquid remaining on the plate-shaped material can be removed quickly and positively.

SUMMARY OF THE INVENTION

The foregoing object and other objects of the invention have been achieved by the provision of a method of removing liquid from the surface of a plate-shaped material, in which, according to the invention, a larger part of the liquid is removed from the surface of the plate-shaped material with first liquid removing means which has a solid scraping surface set adjacent the surface of the plate-shaped material, and the liquid remaining on the surface of the plate-shaped material is removed with second liquid removing means comprising an air knife.

DESCRIPTION OF THE PREFERRED EMBODIMENTS

An example of a liquid removing method according to the invention will be described in detail with reference to the accompanying drawings.

Figure 1:
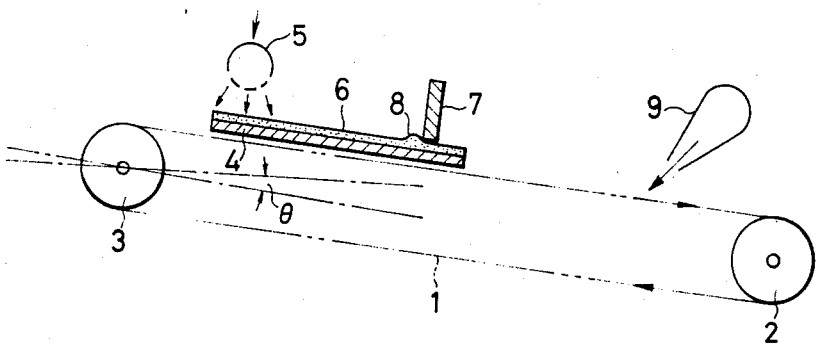
FIGS. 1 and 2 are side views showing essential components of apparatuses for practicing a liquid removing method according to this invention.

FIG. 1 is a side view showing the essential components of an apparatus for practicing the method of the invention.

As shown in FIG. 1, an endless belt 1 is laid on a driving roller 2 and a driven roller 3. The endless belt 1 is adapted to continuously convey an aluminum plate 4 in such a manner that the plate 4 is moved downwardly at an angle $\theta$ of about 5°.

The aluminum plate 4 on the endless belt 1 is first moved under a shower spray 5 where cleaning water 6 is supplied to clean the upper surface. After the upper surface of the aluminum plate 4 has been cleaned with the cleaning water 6, the aluminum plate 4 is moved under a first liquid removing device 7, which is here a vinyl chloride resin plate whose lower end face is held adjacent to the upper surface of the endless belt 1. There is a small gap (0.2 to 0.4 mm, for instance) between the lower end face of the first liquid removing device 7 and the upper surface of the aluminum plate 4. Therefore, the layer of cleaning water 6 formed on the aluminum plate 4 is scraped off by the lower end face of the first liquid removing device 7. A bead 8 which rises slightly is formed upstream of the first liquid removing device as the cleaning water 6 is scraped off as described above. Therefore, a larger part of the cleaning water layer 6 falls down the bead 8.

The aluminum plate 4 passed through the small gap is further moved downwardly. In this operation, the cleaning water 6 remaining on the upper surface of the aluminum plate is scraped off by the flow of compressed air from the tip of an air knife 9, which constitutes a second liquid removing device provided downstream of the first liquid removing device 7. As the larger part of the cleaning water layer 6 on the aluminum plate is removed by the first liquid removing device 7, the air knife 9 can remove the remaining cleaning water 6 with a relatively low pressure. Thus, the problem of the cleaning water 6 remaining on the aluminum plate being excessively scattered is prevented, and the surrounding area is maintained clean.

Figure 2:
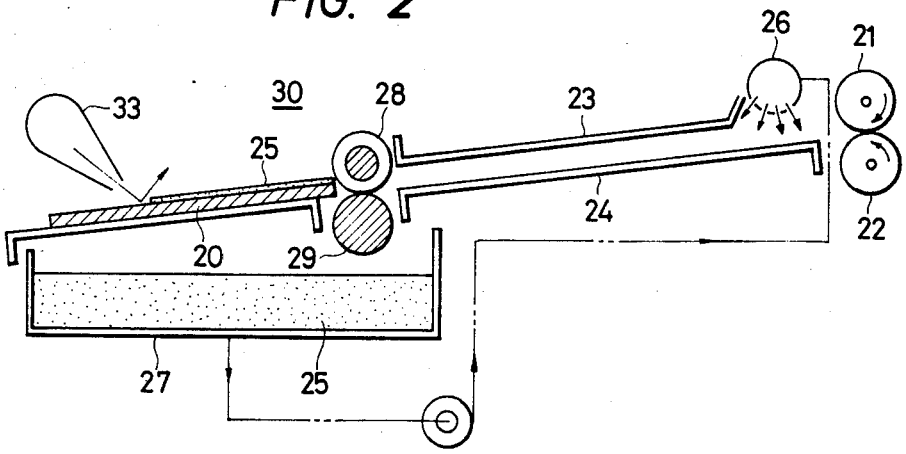
Figure 3:
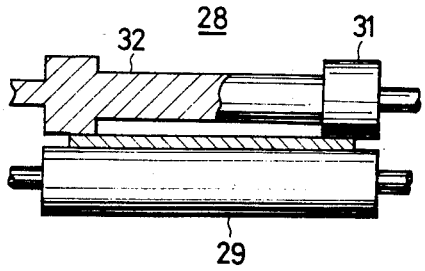
FIG. 3 is an enlarged view showing a first liquid removing device in FIG. 2.

FIG. 2 shows a liquid toner removing apparatus which is employed in the case where an aluminum plate coated with electrophotographic photosensitive material is developed with wet electrophotographic liquid toner. The liquid toner 25 is applied to the upper surface of the aluminum plate 20 by a shower spray 26 before the aluminum plate is delivered by nip rollers 21 and 22 arranged on the upstream side into a "down" passage defined by the upper and lower guide boards 23 and 24. The liquid toner 25 applied to the aluminum plate drops by force of gravity into a container 27 provided below the passage.

A latent image formed on the aluminum plate 20 is developed with the liquid toner 25 applied thereto, and the aluminum plate 20 is delivered to a first liquid removing device 30 constituted by a pair of rollers 28 and 29. The roller 28 of the first liquid removing device 30 consists of two end pairs 31 and an intermediate part 32 between the two end parts 31. The two end parts 31 are larger in diameter than the intermediate part 32. The roller 29 is a normal straight roller. Therefore, the aluminum plate 20 is further moved downwardly by the nipping action of the rollers 28 and 29 on two marginal portions of the aluminum plate. As a small gap is formed between the intermediate part 32 (smaller in diameter) of the roller 28 and the ordinary straight roller 29, the intermediate part of the aluminum plate which is defined by the two marginal parts, that is, the developing region, is prevented from contacting other solid surfaces.

A larger part of the liquid toner layer formed on the upper surface of the aluminum plate 20 by spraying is squeezed off while the aluminum plate is passing through the gap and is collected in the container 27. The liquid toner 25 remaining on the aluminum plate 20 which could not be removed by the first liquid removing device 30 is completely removed by a second liquid removing device, namely, an air knife 33, similar to the case of the apparatus shown in FIG. 1.

As described above, in the method of the invention, after the upper surface of a plate-shaped material is subjected to a liquid surface treatment, a larger part of the liquid layer is scraped or squeezed off with the solid surface of the first liquid removing device, and then the liquid remaining on the plate-shaped material is removed by the second liquid removing device which is an air nozzle. Accordingly, during the liquid removing operation, the surface under treatment is protected from damage, and the liquid will not be excessively scattered. Especially, the air capacity and air pressure of the air knife can be set to relatively small values.

In order to clarify the novel effects of the method according to the invention, examples and comparison examples thereof will be described.

EXAMPLE I

The apparatus shown in FIG. 1 was used. While an aluminum plate 0.3 mm in thickness, 550 mm in width and 460 mm in length was being conveyed at a speed of 3.4 m/min, its upper surface was washed with cleaning water, and the cleaning water was removed from the upper surface.

Other conditions were as follows:

Cleaning water supplying rate—2.5 liters/min

First liquid removing device—A vinyl chloride resin board 2 mm in thickness was used. The gap between the lower end face thereof and the aluminum plate was 0.2 mm.

Second liquid removing device—The gap between the upper surface of the aluminum plate and the end of the nozzle was 2 mm. The air pressure was 1100 mm Ag. The air quantity was 650 liters/min. The air flow velocity was 18 m/sec.

The cleaning water could be completely removed from the upper surface of the aluminum plate without scattering.

Comparison Example I

A liquid removing operation was carried out under the same conditions as those in Example I except that the first liquid removing device was removed from the apparatus and the air knife was operated under the following conditions:

Air knife—the air pressure was 1200 mm Aq. The air quantity was 1100 liters/min. The air flow velocity was 30 m/sec.

In the liquid removing operation, the liquid was strongly scattered upstream of the air knife.

EXAMPLE II

The apparatus shown in FIG. 2 was used. An aluminum plate 0.24 mm in thickness, 550 mm in width and 460 mm in length was coated with electrophotographic photosensitive material. While the aluminum plate was being conveyed at a speed of 3.4 m/min, development was carried out with liquid toner, and the liquid toner was removed from the aluminum plate. Other conditions were as follows:

Liquid toner supply rate—2.5 liters/min.

First liquid removing device—A pair of rubber rollers arranged vertically was used. The two end portions of the upper roller were wrapped with a 100 micron PET film so that a gap of 0.15 mm was formed between the upper roller and the lower roller.

Second liquid removing device—An air knife was used under the same conditions as those in Example I.

The liquid toner could be completely removed from the upper surface of the aluminum plate without scattering.

Comparison Example II

A liquid toner removing operation was carried out under the conditions that the first liquid removing device in Example II was removed from the apparatus and the second liquid removing device, i.e., the air knife, was set similarly as in Comparison Example I.

In the liquid toner removing operation, the liquid was severely scattered upstream of the air knife.

We claim:

1. A method for removing liquid (25) from an upper surface of a planar plate (20), comprising the steps of: conveying said plate downwardly at an angle $\theta$ inclined approximately 5° to a horizontal, removing a larger part of said liquid from the surface of said plate with first liquid removing means (30) having a solid surface adjacent to the surface of said plate; and removing liquid remaining on the surface of said plate by second liquid removing means comprising an air knife (33);

wherein said first liquid removing means comprises a pair of rollers (28, 29), said plate passing through a nip formed between said rollers;

wherein a first one of said rollers comprises two end parts (31) and an intermediate part (32) between said two end parts, said two end parts having a larger diameter than said intermediate part, and the other one of said rollers comprises a straight roller of substantially identical length as said first one of said rollers;

wherein said end parts of said first one of said rollers engage opposite margin portions of said upper surface of the planar plate; and wherein said air knife is separate from said pair of rollers, functions independently thereof, and is spaced substantially downstream therefrom in the direction of conveyance.

2. The method of claim 1, wherein an air flow rate and an air pressure of air flowing through said air knife are sufficiently low to prevent significant scattering of said liquid from the surface of said plate-shaped material.

* * * * *